United States Patent [19]

Gentil

[11] 4,161,830

[45] Jul. 24, 1979

[54] DEVICE FOR IDENTIFYING INGOTS OR CASTINGS

[75] Inventor: Patrick R. Gentil, Saint-Cloud, France

[73] Assignee: Calider, Saint-Chamond, France

[21] Appl. No.: 859,953

[22] Filed: Dec. 12, 1977

[30] Foreign Application Priority Data

Dec. 30, 1976 [FR] France ..... 76 39669

[51] Int. Cl.[2] ..... G09F 3/02

[52] U.S. Cl. ..... 40/2.2; 40/600

[58] Field of Search ..... 40/2.2, 2, 621, 310; 164/4; 249/202, 197, 205, 103, 104; 273/239; 248/206 A

[56] References Cited

U.S. PATENT DOCUMENTS

| | | | |
|---|---|---|---|
| 655,393 | 8/1900 | Coleman | 164/4 |
| 1,561,427 | 11/1925 | Forsberg | 164/4 X |
| 2,761,229 | 9/1956 | Friedly et al. | 40/2.2 |
| 2,800,730 | 7/1957 | Loring et al. | 40/2.2 |
| 3,239,187 | 3/1966 | Daley | 249/202 |
| 3,506,236 | 4/1970 | Brawner | 249/202 |
| 3,643,358 | 2/1972 | Morderosian | 40/2.2 |
| 4,005,866 | 2/1977 | Marcil | 273/239 |

*Primary Examiner*—Louis G. Mancene
*Assistant Examiner*—Wenceslao J. Contreras
*Attorney, Agent, or Firm*—Haseltine, Lake & Waters

[57] ABSTRACT

A device for use in identifying ingots or castings comprises a thin planar body of a refractory material which has a characteristic shape and a dovetail cross-section so that the body has one face with a smaller surface area than the opposite face, and a magnet incorporated in said body in said one face having a smaller surface area. The device is placed in the mould for the ingot or casting and is held to a wall thereof by magnetic attraction.

4 Claims, 1 Drawing Figure

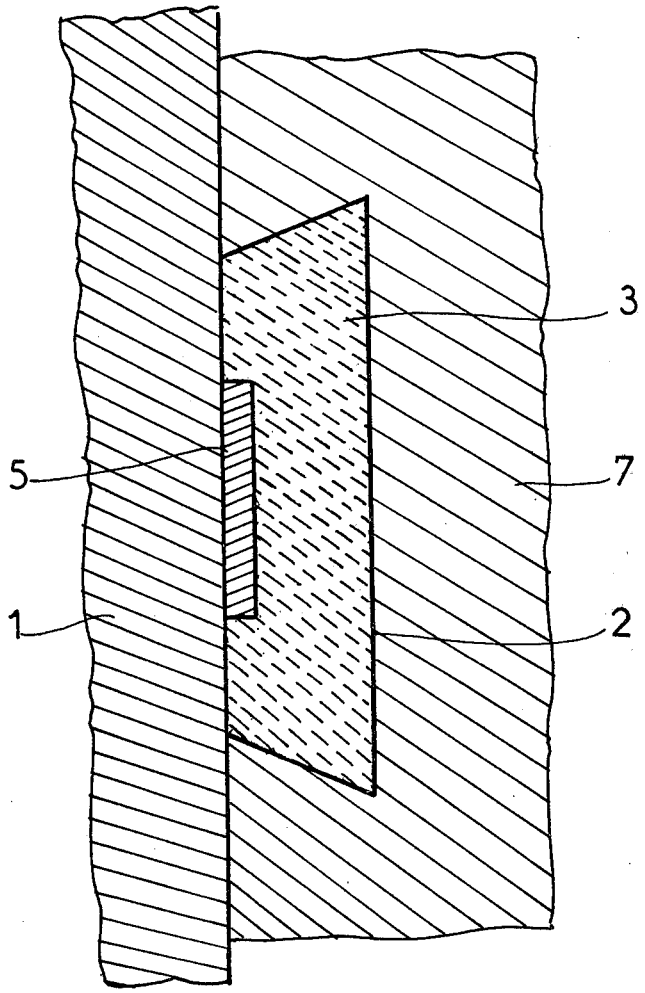
3
5
7
1
2

DEVICE FOR IDENTIFYING INGOTS OR CASTINGS

The present invention relates to the marking for identification purposes of ingots and castings.

In the metallurgical industries, attempts have been made for a long time to mark, for identification purposes, the various ingots or castings produced in a factory, in particular those which must subsequently undergo a hot shaping process. It is known that in a metallurgical factory, the ingots or castings are, after production, subjected to several handling operations until they reach the workshop where subsequent treatments, such as, for example, rolling, will be carried out. Such handling operations can also be necessary between the various stages of a hot shaping process.

During these handling operations, confusion can arise between ingots, resulting in serious mistakes and severe damage during subsequent operations. Such confusion is obviously to be feared between ingots or cold castings, but the hazard is greater still where ingots or castings which are still incandescent are concerned, because the ingots or castings of different compositions originating from different batches cannot be distinguished simply by their external appearance.

Where ingots or castings of different compositions are produced in parallel lines, using identical ingot-moulds or casting moulds, they cannot be distinguished by either their shape or their size. It is thus essential, from the point of view of the different subsequent shaping operations which depend on their respective destination or future use, to be able to identify the batch from which the ingot or the casting originated and hence to be able to identify its composition. Where cold ingots or castings are concerned, it is obviously possible to apply distinctive marks to them by means of chalk, paint or any similar means, but this very simple process is inapplicable in the case of incandescent castings.

Plates carrying the numbers of the casting runs or of the batches are sometimes used to identify ingots. However, this solution is not entirely satisfactory because once again the use of these plates is only feasible when the ingots or castings are cold. It is also known to make marks, e.g. numerals or letters, in relief, or recessed in, on the surface of the ingots or castings. The disadvantage of these solutions is that at the temperature of 1,200° to 1,250° C. required for hot shaping of the ingots and castings, these marks imprinted in the actual material of the castings do not stand out and cannot be distinguished. As a result of all these difficulties it is most frequently necessary to identify ingots and castings by means of accompanying documents, which does not entirely eliminate the danger of confusion but on the other hand complicates and adds to the administrative work of the metallurgical treatment workshops.

It is of course possible to identify an ingot or casting by determining the chemical composition of the ingot or casting by laboratory analyses. However, this method is only a rescue solution to be employed in the case where confusion has already occurred. The problem consists exactly in finding a solution which eliminates this risk of confusion. In fact, such analyses can in general only be carried out on samples taken cold, so that in case of confusion it is necessary to wait for the ingots or castings to cool in order to identify them reliably, which results in losses of time and waste of energy and is in every case an economic disadvantage.

A process is also known in which marking is effected by means of a character made of a plastics foam body impregnated with a refractory product. Such characters are intended to be placed in the ingot moulds and to be incorporated in the ingot after release from the mould. However, this process has serious disadvantages, first of all due to the fact that the plastics foam of the body produces, on casting, impurities which are miscible with the steel and which cause metallurgical disadvantages, particularly in the case of special steels. Now it is precisely in the case of special steels with very precise graduation of properties that it is particularly necessary to be able to identify very precisely each of the ingots. Furthermore, the application of such characters is particularly difficult on the internal walls of the ingot mould if the characters are not to be carried away be the molten metal during casting. In practice, these characters can thus only be positioned by nailing them onto the feeders located in the upper part of the ingot mould and intended to produce a hotter zone where the metal remains liquid for a longer time. The result of this is, first of all, that on releasing the ingot from the mould the identification characters are covered and hidden by the remainders of the feeders, which makes the characters invisible at the time of release from the mould. Furthermore, these characters are located in the upper zone of the ingot, that is to say in the zone where the ingot is seized by grippers or handling devices, and the characters can thus easily be damaged during handling.

It is an object of the present invention to overcome these disadvantages and make it possible to produce identification devices which are easy to position reliably, do not introduce any impurity into the metal of the ingot, and remain visible both cold and hot, from release of the ingot from the mould up to the first rolling operations.

According to one aspect of the invention, a device for use in marking an ingot or casting made in an ingot mould or a metal mould, comprising a body of a refractory material, said body having a low thickness and a characteristic shape, said body having a "dovetail" cross-section so that said body has one face having a smaller surface area than the opposite face, and a magnet incorporated in said refractory body and located in said one face having said smaller surface area.

According to another aspect of the invention the above described device is made by:

(a) producing a moist paste containing a mixture of 60 to 80% of corundum containing from 0.5 to 1.5% of chromium oxide, and of 20 to 40% of a binder consisting of $\frac{1}{3}$ of hydrated aluminum phosphate and $\frac{2}{3}$ of magnesium sulphate, (b) stamping the paste in a mould having said characteristic shape after having inserted a magnet into the mould, and (c) drying at a temperature below 150° C.

According to a further aspect of the invention, an ingot or casting is marked by fixing at least one device as described above to a metal wall of said mould by placing said device with said one face including said magnet against said wall, in the zone not covered by feeders for said mould and outside zones where the ingot or casting is to be gripped by handling means.

The invention will now be described in greater detail with reference to a particular embodiment thereof, given by way of example only, and illustrated in the accompanying drawing.

In the drawing, the single FIGURE is a partial cross-section through an ingot and its ingot mould in a zone which also contains an embodiment of an identification device according to the invention.

The drawing shows a part of the wall 1 of an ingot mould, and an identification device 2 applied against the wall 1. The device 2 consists of a flat body of low thickness, made from a refractory material 3 and moulded in the shape of an identification character. On one of its faces the device carries a magnet 5 incorporated in the refractory material and with its outer surface flush with the face of the device. It will furthermore be seen that the cross-section of the device is in the general shape of a trapezoidal "dovetail" with the magnet in the smaller area face.

The device, the composition and method of production of which will be described hereafter, can thus easily be fixed, by magnetic attraction, to any part of the metal wall of the ingot mould. The identification of the ingot can be made up from single device or a series of devices representing the same and/or different characters which can take the form of numerals, or letters or of any other sign, so that any desired identification combination can be produced. During casting, the molten metal will progressively surround all the devices 2 and the magnetic attraction provided by each magnet 5 will be sufficient to resist the forces due to the flow of the molten metal. It may be noted that during casting the refractory material 3 of the device 2, which is a poor conductor of heat, prevents the magnet 5 from rapidly becoming hot during casting and reaching the temperature at which it would lose its magnetic properties. Thus this temperature is virtually only attained at the instant at which the metal of the ingot is already sufficiently solidified and at which the internal flow in the liquid metal is sufficiently weak that the device will no longer be moved.

After solidification, and on release from the mould, the devices 2 are incorporated and held in the solidified ingot and thus remain integral with the ingot. p The devices 2 are manufactured from a refractory ceramic obtained from a moist past consisting, for example, of 60 to 80% of corundum containing from 0.5 to 1.5% of chromium oxide, mixed with 20 to 40% of a binder composed of $\frac{1}{3}$ of hydrated aluminium phosphate and $\frac{2}{3}$ of magnesium sulphate. From this moist mass, devices of the desired shape and size are produced by stamping after having inserted the magnet 5 into the stamping mould. The raw mouldings thus obtained are then dried at a temperature below 150° C., which is sufficient to make it possible to achieve adequate strength. Devices are thus obtained which remain visible by contrast both when the ingot is cold and dark and on the incandescent steel of the reheated ingot.

The general shape and the size of the devices can vary within a very wide range depending on the requirements and on the size of the ingots with which the devices are to be used. However, their thickness must remain low, for example between 2 and 5 millimeters. It will be noted that the devices thus incorporated into the ingot do not in any way protrude from the external surface of the ingot so that they will neither become detached nor drop off after solidification of the ingot or of the casting. During handling operations, the characters will also not become attached to the various gripping devices. For yet greater safety, and in order to take account of the case where an identification device might accidentally break and detach prematurely from the ingot, aluminium powder can be mixed thoroughly with the moist paste during the production of the devices. In this case, the aluminium contained in the device in fact diffuses very slightly at the surface of the steel and this very slight impurity, which is solely a surface impurity and which will disappear with the oxygenation crust during subsequent treatments, suffices to produce a different colour and visibly show up, even from afar, the outline of the character which has disappeared.

If the ingot or the casting is stored cold, the above described devices retain their identification property and in particular outdoor storage does not cause any corrosion or deterioration of the devices, which retain their marking and identification role up to a new hot treatment. During a subsequent hot treatment, for example a rolling operation, the high forces exerted on the ingot break the device 2, which become detached from their hollow seat. As the devices are of low thickness, hardly greater than that of the oxygenation crust, which disappears on rolling, the hollow left by the devices will be filled and will disappear without trace during the rolling operation, without disadvantage and without any problem as regards the subsequent operations. As the refractory material of the devices is not miscible with the steel, no impurity remains in the steel.

Finally, it will have been noted that the positioning of the devices in the ingot mould is particularly easy because of the magnetic attraction and that these devices can thus be placed in any area of the ingot mould. It is in particular easy to avoid the zones corresponding to the parts of the ingot which will subsequently be crushed and to avoid the parts of the ingot where there is a risk of the devices being damaged by the usual handling apparatus.

Of course, the invention is not intended to be strictly limited to the embodiment which has been described by way of an example only, and instead embraces embodiments which only differ therefrom in details, in differences of execution or in the use of equivalent means.

What is claimed is:

1. A device for use in marking an ingot or casting made in an ingot mould or a metal mould, comprising a body of a refractory material, said body having a low thickness and a characteristic shape, said body having a "dovetail" cross-section so that said body has one face having a smaller surface area than the opposite face, and a magnet incorporated in said refractory body and located in said one face having said smaller surface area.

2. A device accordng to claim 1, wherein said body has a thickness of the order of 2 to 5 millimeters.

3. A device according to claim 1, wherein said refractory material is produced from a mixture of 60 to 80% of corundum containing from 0.5 to 1.5% of chromium oxide, and of 20 to 40% of a binder consisting of $\frac{1}{3}$ of hydrated aluminium phosphate and $\frac{2}{3}$ of magnesium sulphate.

4. A device according to claim 3, wherein said mixture includes aluminium powder.

* * * * *